US005562206A

United States Patent [19]

Keller

[11] Patent Number: 5,562,206

[45] Date of Patent: Oct. 8, 1996

[54] CONTAINER FOR SEVERAL OBJECTS

[75] Inventor: Felix K. Keller, Zurich, Switzerland

[73] Assignee: Stratop Management Und Treuhand AG, Zollikon, Switzerland

[21] Appl. No.: 575,590

[22] Filed: Dec. 20, 1995

Related U.S. Application Data

[63] Continuation of Ser. No. 196,211, filed as PCT/CH93/00178 published as WO94/01331 Jan. 20, 1994, abandoned.

[30] Foreign Application Priority Data

Jul. 13, 1992 [CH] Switzerland ..... 02202/92

[51] Int. Cl.[6] ..... B65D 85/10

[52] U.S. Cl. ..... 206/249; 206/804; 206/815

[58] Field of Search ..... 206/249, 254, 206/255, 268, 242, 271, 273, 804, 815

[56] References Cited

U.S. PATENT DOCUMENTS

| | | | |
|---|---|---|---|
| 1,456,060 | 5/1923 | Johnstone | 206/249 |
| 4,664,310 | 5/1987 | Schmidt | 206/255 X |
| 4,942,961 | 7/1990 | Focke et al. | 206/255 X |
| 4,949,841 | 8/1990 | Focke et al. | 206/254 |
| 5,301,804 | 4/1994 | Focke et al. | 206/254 X |

FOREIGN PATENT DOCUMENTS

| | | |
|---|---|---|
| 601047 | 2/1926 | France . |
| 9111288 | 10/1991 | Germany . |
| 166861 | 8/1921 | United Kingdom . |
| 1385540 | 2/1975 | United Kingdom . |

OTHER PUBLICATIONS

International Search Report and Annex in English and German.

*Primary Examiner*—Jacob K. Ackun
*Attorney, Agent, or Firm*—Greenblum & Bernstein P.L.C.

[57] ABSTRACT

A container for holding several objects, such as cigarettes, is provided. The container includes a cover plate located on a bottom of the container and pivotable relative to a pivot axis formed in a back wall. An inward pivoting of the cover plate imparts an upward movement to the cigarettes located atop the cover plate. The container also includes two opposing tabs that restrict the pivotable movement of the cover plate to movement within the container.

6 Claims, 3 Drawing Sheets

FIG. 2
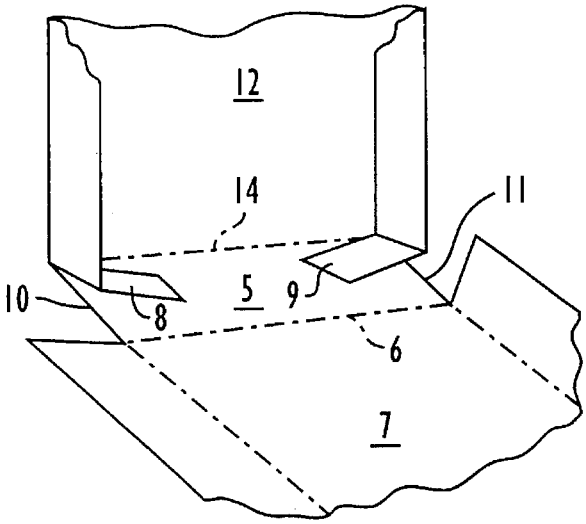
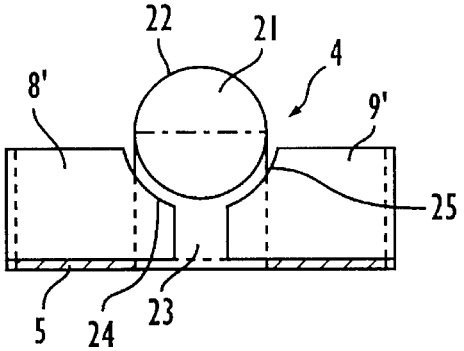
FIG. 4
FIG. 5
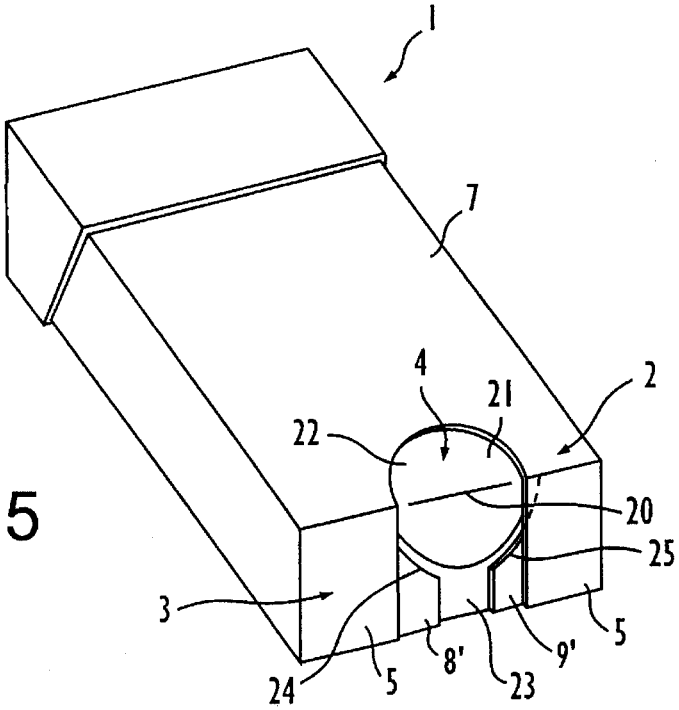

CONTAINER FOR SEVERAL OBJECTS

This application is a continuation of application Ser. No. 08/196,211, filed as PCT/CH93/00178 on Jul. 13, 1993, published as WO94/01331 on Jan. 20, 1994, now abandoned.

CROSS REFERENCE TO RELATED APPLICATIONS

This application claims the priority of PCT Application No. PCT/CH93/00178, filed Jul. 12, 1993, which in turn claims the priority of Swiss Application No. 2202/92-0, filed Jul. 13, 1992, the disclosures of which are incorporated herein by reference in their entireties.

BACKGROUND OF THE INVENTION

1. Field of the Invention

This invention pertains to a container for several objects which can be manually removed therefrom via a container opening. Such a container can, for example, be formed as a box in the form of a parallelepiped and be comprised of a cigarette box made of cardboard which utilizes a pivotable flap at the container opening.

2. Discussion of the Background of the Invention and Material Information

In this known hard package, the cigarettes are tightly packed and can thus be removed only with difficulty. It is thus an object of this invention to produce such a container, for example, in the form of a cigarette box, from which the cigarettes can be removed in a manner easier than heretofore.

The container of this invention is characterized via a withdrawal device located opposite to the container opening, wherein a part of the container wall, opposite to the container opening, takes the form of a cover plate that is pivotable into the interior of the container for the ejection of one or more objects lying in the movement path of the cover plate.

If the container of this invention takes the form of a cigarette box, the container opening is located on one of the small sides of the box. In the withdrawal device with its cover plate is located at the other small side of the box. In the following description the container will be discussed in the embodiment of a cigarette box.

SUMMARY OF THE INVENTION

The difficult removal of cigarettes from the pack is solved by this invention via a cigarette box in the form of a carton, for retaining a cigarette pack encompassing a plurality of cigarettes, which cigarettes can be manually removed therefrom singly, said cigarette box comprising in combination: a box opening; a withdrawal device, the withdrawal device being located opposite the box opening; a portion of a box wall, located opposite to the box opening, taking the form of a cover plate having a flat side, with the cover plate being pivotable into the interior of the box; the cover plate having a pivot axis, with the pivot axis extending along the width of the box; the cover plate having a portion that lies on a front side of the box and is pivotable around the cover plate pivot axis; and the width of the cover plate extending only over a portion of the width of the box, so that during the inwardly pivoting movement of the cover plate the cover plate transfers differing movement paths to the cigarettes via the flat side of the cover plate, with the flat side coming to rest obliquely from a rear lower face to a front upper face, so that the cigarettes extend at differing lengths at the box opening and extend at the front side of the box and of the greatest axial extent an center region of the front side.

In one embodiment of the cigarette box of this invention a small side of the box includes two tabs and a first box wall and the first box wall covers the two tabs from the outside of the box, with the two tabs overlapping the cover plate from the outside in order to prohibit a pivotable movement of the cover plate past the first box wall to the outside of the box.

In another embodiment of the cigarette box of this invention a small side of the box includes two tabs and a first box wall, with the two tabs overlapping the first box wall and the cover plate from the outside of the box, with the two tabs each adhering at an adjoining portion of the first box wall to prohibit a pivotable movement of the cover plate over the first box wall to the outside of the box.

In a further embodiment of the cigarette box of this invention the cover plate is unitary with a third box wall and that the pivot axis lies between the cover plate and the third box wall, with the first box wall, via a first and a second folding line, adjoining a second and a third box wall, so that the pivot axis, relative to second folding line, is shifted into the third box wall.

In yet another embodiment of the cigarette box of this invention cover plate is of an L-shape and the pivot axis lies on a fixed leg end of the L-shape.

Preferably, the cover plate portion that lies on the front side of the box is one of a semicircular, square, U and triangular shape, and of a color differing from that of the front side of the box.

The present invention also pertains to a cut sheet for forming the previously-defined cigarette box, with the cut sheet comprising in combination: a first box wall; a second box wall adjoining the first box wall via a first folding line; two tabs adjoining the first box wall via a first and a second cut line; and the cover plate adjoining a third box wall via a pivot axis and adjoining the first and second box walls via a third cut line.

Preferably, in the cut sheet of this invention the third cut line extends into the third box wall and the pivot axis as well as the first and second folding lines extend parallel to one another.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein there is shown:

FIG. 2 is a portion of the known cut sheet of FIG. 1 in a partially assembled condition, FIG. 4 is a cross section taken along line IV—IV of FIG. 3, showing a partially assembled blank, FIG. 5 is a perspective representation of the container of this invention in the form of a cigarette box.

DETAILED DESCRIPTION OF THE PREFERRED EMBODIMENTS

Figure 1:
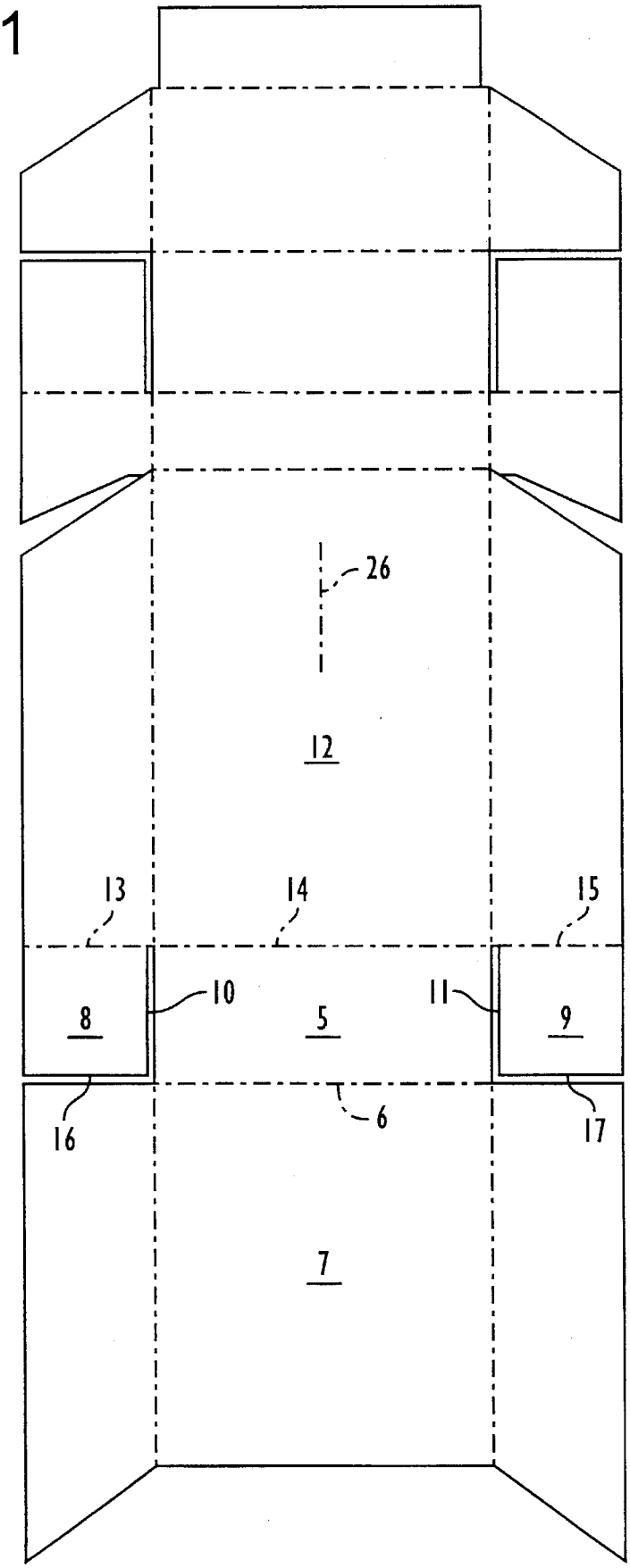
FIG. 1 is a top plan view of cut sheet for a hard package, comprised of cardboard, for a customary, well-known cigarette box.

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

The container for several objects, in the present example, takes the form of a cigarette box, pack, or package wherein the objects therein are cigarettes which can be manually removed therefrom via a container opening 1. The container has a withdrawal device 2 located opposite to the container opening 1 wherein a portion of a container side 3, located opposite to the container opening 1, takes the form of a tab or cover plate 4 that is pivotable into the interior of the container for the ejection of one or more cigarettes that lie in the movement path of the cover plate or tab 4. The cigarette box, which is preferably made of cardboard, is formed as a parallelepiped, wherein the container opening 1 is located on a small side of the box and the withdrawal device 2, with its cover plate 4, being located on the other small side of the box.

In order that the container of this invention (cigarette box), as shown in FIG. 5, can readily be produced, there is the prerequisite that the container can be made with the least possible changes to the machines that are utilized for the production of the present customary cigarette boxes, so that only minimal and cost effective changes are necessary on the existing machine lines for the production of cigarette boxes in large quantities. FIG. 1 shows the cut sheet of a customary, prior art, cigarette box, which is made of cardboard. This customary, known, cut sheet has a first box wall 5 in addition to an adjoining second box wall 7, separated via second folding line 6. In addition, two tabs 8 and 9 are present, which adjoin first box wall 5 via a first cut line 10 and a second cut line 11. The known cut sheet, in addition, has a third box wall 12. Furthermore, folding lines 13, 14 and 15, as well as cut lines 16 and 17 are also present. In FIG. 1 only those parts of the known cut sheet are described that are necessary for the understanding of this invention. From FIG. 2 it should be clear how the known cut sheet is folded, in those areas provided with reference numerals, for forming the known container (cigarette box). This known part of the known cut sheet, as shown in FIGS. 1 and 2 is now changed, in one embodiment of this invention, to the form thereof shown in FIG. 3.

A cover plate, platelet or tab 4, is provided with an outer contour 18 and 19, wherein contour 18 illustrates a third cut line, with contour 19 being the first folding line. From FIG. 3 it should be clear that the first box wall 5 adjoins second box wall 7. Cover plate 4 adjoins third box wall 12 via folding line 19. Both folding lines 6 and 19 are parallel with each other; in the same manner folding lines 14 and 19 are parallel with each other. From FIG. 3 it should also be clear that folding line 19, is shifted, relative to folding line 14, for example, for the thickness of the cardboard or more, so that folding line 19 extends into the third box wall 12.

Figure 3:
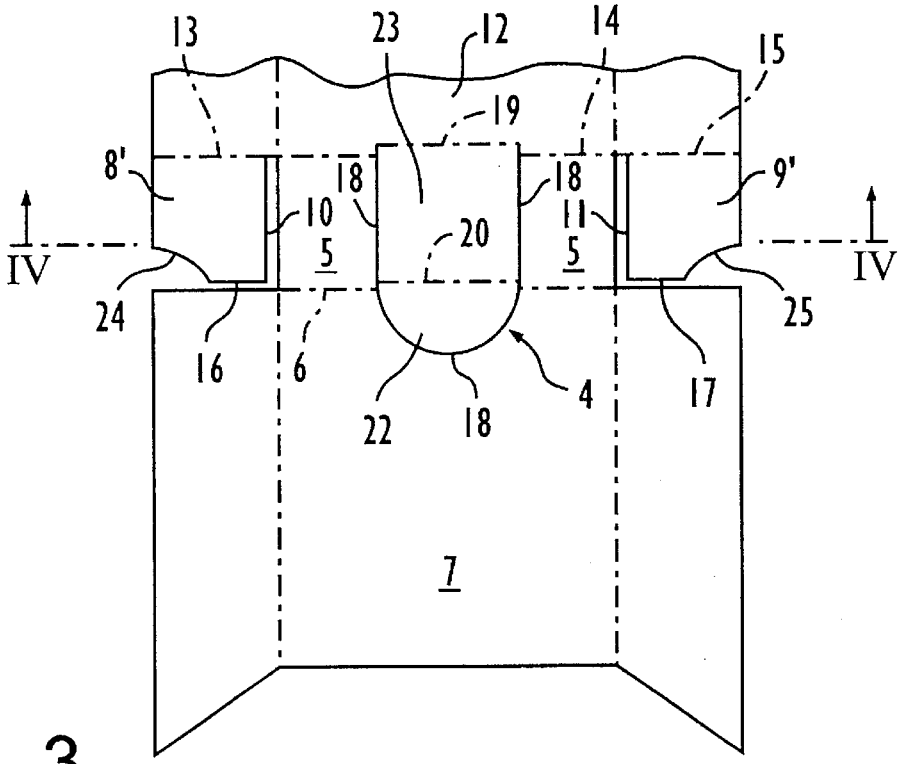
FIG. 3 is a top plan view of the cut sheet of this invention for forming the container of this invention.

In the assembled cut sheet, cover plate 4 is bent at right angles about folding line 20 so that cover plate 4 becomes L-shaped. First folding 19 lies at the fixed leg end of the L-shape. In the assembled cut sheet, that is in the container, the semicircular leg portion of cover plate 4 lies in the plane of the second box wall 7 and the other portion of cover plate 4 lies in the plane of container side 3 (FIG. 5). For the optical enhancement of cover plate 4, relative to the remaining container, cover plate 4 can, for example, be provided with a colored circular blank 21, in the manner set forth in FIGS. 4 and 5. This round blank is, for example, adhered to cover plate 4 and also L-shaped via folding line 20. In the examples of FIGS. 3–5, cover plate 4 is comprised of a semicircular part 22 and a rectangular part 23. The known tabs 8 and 9, as per FIGS. 1 and 2, are provided, as per the example of FIGS. 3–5, with cutouts 24 and 25, thus forming tabs 8' and 9'. Via the use of cutouts 24 and 25, tabs 8' and 9' are fitted to the contour of circular blank 21, as set forth in FIGS. 4 and 5.

Even in the known container, with the cut sheet of FIGS. 1 and 2, the box wall 5 covers the two tabs 8 and 9, from the outside; the same also being the case in the container of this invention, as per FIGS. 3 to 5, wherein the box wall 5 covers tabs 8' and 9' from the outside. In the illustrated example of FIGS. 4 and 5, the two tabs 8' and 9' cover the cover plate 4 from the outside, to prohibit a pivotal movement of the cover plate 4 past the box wall 5 to the outside. The same result can also be achieved, when, in a second non-illustrated example, the cut sheet, as per FIG. 3, is assembled differently, that is, so that the two tabs 8' and 9' overlap the box wall 5 on the outside, that is no longer within the box wall 5 but rather lying on the outside thereof, whereby the two tabs 8' and 9' must each be attached on an adjacent portion of the box wall 5, for example via pasting. Due to this pasting, this embodiment is a less advantageous solution.

From FIG. 3 it should be clear that folding line 19, relative to folding line 14, is shifted or displaced into box wall 12. The amount of this displacement can correspond to or exceed that of the thickness of the cut sheet. This achieves that the cover plate, in the position shown in FIG. 5, can be pivoted underneath box wall 7 and additionally, that the semicircular cover plate part 22 undercuts the contour of cut line 18 so that, in the position shown in FIG. 5, the cover plate part 22 cannot pivot over box wall 7 to the outside.

In order to form the container as per the examples shown in FIGS. 3–5 from the known cut sheet of FIGS. 1 and 2, only the cut line 18, the folding lines 19 and 20, as well as the cutouts 24, 25, must be produced. Thereafter, a colored circular blank 21 can be adhered to cover plate 4.

Figure 6:
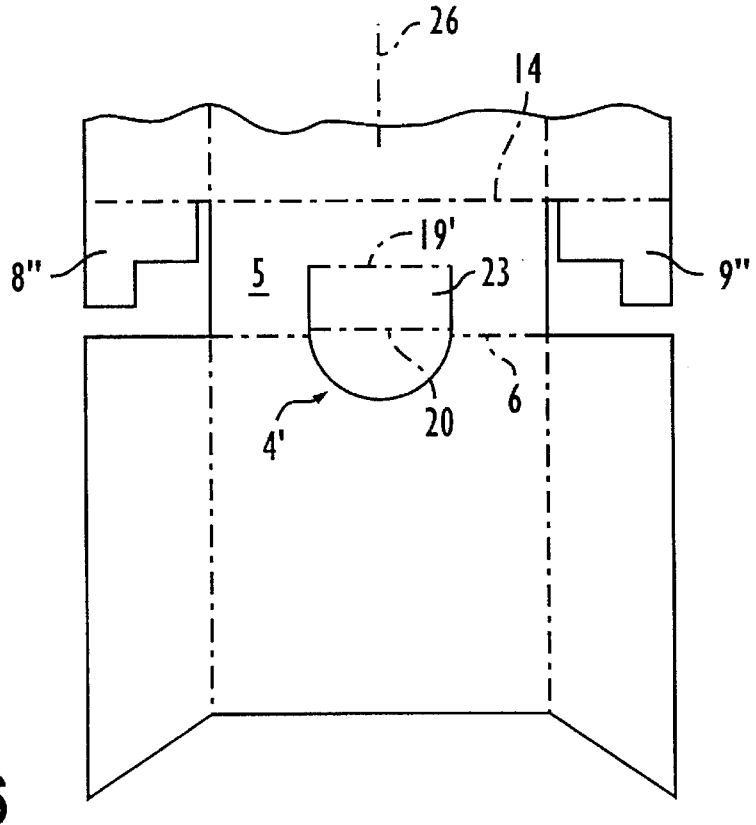
FIG. 6 is a further embodiment of the cut sheet of this invention for a different-shaped withdrawal device, in the same view as FIG. 3.

In the example of FIG. 6, the cover plate 4' has a somewhat differing form since its rectangular part 23 no longer extends over the entire height of box wall 5, but rather only about over half of its height, so that the folding line 19' of the cover plate lies at about the middle between both of the folding lines 14 and 6. The tabs 8" and 9" also have differently formed cutouts, so that they can again overlap the cover plate 4' from the outside, in order to prohibit a pivotal movement of the cover plate past the box wall 5 to the outside. The folding line 20 is again shifted relative to folding line 6, in the same manner as in the example of FIG. 3. It should also be noted, that in the example of FIG. 3, the spacing of both folding lines 19 and 20 from each other is the same as the spacing of the folding lines 6 and 14 from each other, so that as already noted, the cover plate can be pivoted under box wall 7 and undercuts same.

In further, non-illustrated, embodiments, the cover plate can also have other shapes, particularly part 22 of the cover plate lying at box wall 7. This cover plate part 22 can, in addition to the illustrated semicircular shape, also be square, U-shaped or of triangular form. The particular shape of the cover plate part 22 can thus also be adapted, in an aesthetic manner to remaining design of box wall 7.

In the noted working embodiment of the container, the inwardly pivoted cover plate impinges upon the lower end face or area of one or more cigarettes, which are thereby pushed to the outside at the container opening, that is in the longitudinal direction of the cigarettes. In a different working example of the container, and other arrangement of the cigarettes in the container, the cover plate can also act on the cigarettes in a transverse direction, so that they can be transferred out of the container opening in the transverse direction.

The container need not take the form or shape of a cigarette box but can also serve for the retention of other objects.

In the illustrated working example of the cut sheet as per FIGS. 3 and 6, the cover plates 4 or 4' are located in the middle or center of the container, that is in the axis of symmetry 26. In a further working example the cover plate can also be arranged out of center, that is laterally displaced relative to axis 26.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A cigarette box in the form of a parallelepiped carton for retaining a cigarette pack including a plurality of cigarettes, the cigarettes being manually removable therefrom singly, said cigarette box comprising:

a box opening on a first small side of said box;

a withdrawal device, said withdrawal device being located on a second small side of said box opposite said box opening;

a cover plate formed within an opening of said second small side and having a flat side, said cover plate being pivotable relative to a pivot axis extending along a width of said box;

said cover plate further including a first portion positioned adjacent a front wall of said box and substantially perpendicular to said second small side;

said pivot axis being formed in a back wall and being positioned parallel to said second small side., said back wall positioned opposite said front wall, wherein pivoting movement of said cover plate imparts upward movement to said flat side of said cover plate, from a position parallel to said second small side to an oblique position inclined with respect to said second small side; and said second small side of said box further including two opposed tabs and a bottom wall, said two tabs being foldable inwardly relative to said bottom wall, wherein said bottom wall, comprising a first layer of said second small side and said two tabs, comprising a second layer of said second small side, said two tabs positioned to overlap a second portion of said cover plate to restrict pivotable movement of said cover to within said box.

2. The cigarette box of claim 1 wherein said cover plate is of an L-shape and said pivot axis lies on a fixed leg end of said L-shape.

3. The cigarette box of claim 1, wherein said first portion of said cover plate that is positioned adjacent said front wall of said box is one of a semicircular, square, U, and triangular shape.

4. The cigarette box of claim 3, wherein said first portion of said cover plate that is positioned adjacent said front wall of said box is of a color differing from that of said front wall of said box.

5. The cigarette box of claim 1, wherein said first layer is positioned at an outside of said second layer.

6. The cigarette box of claim 1, wherein said second layer is adhered to an outside of said first layer.

* * * * *